United States Patent [19]

Sundmar

[11] 3,983,731

[45] Oct. 5, 1976

[54] PRESS FOR HYDROSTATIC EXTRUSION

[75] Inventor: Göran Sundmar, Karlskoga, Sweden

[73] Assignee: Allmanna Svenska Elektriska Aktiebolaget, Vasteras, Sweden

[22] Filed: Jan. 23, 1975

[21] Appl. No.: 543,474

[30] Foreign Application Priority Data

Jan. 29, 1974 Sweden ..... 7401111

[52] U.S. Cl. ..... 72/60; 72/467

[51] Int. Cl.[2] ..... B21C 25/02

[58] Field of Search ..... 72/467, 60, 253, 56

[56] References Cited

UNITED STATES PATENTS

| | | | |
|---|---|---|---|
| 3,364,718 | 1/1968 | Green | 72/467 X |
| 3,436,953 | 4/1969 | Hajikano | 72/467 |
| 3,702,555 | 11/1972 | Larker et al. | 72/272 X |
| 3,751,958 | 8/1973 | Nelsson et al. | 72/264 X |

FOREIGN PATENTS OR APPLICATIONS

| | | | |
|---|---|---|---|
| 1,452,490 | 4/1969 | Germany | 72/467 |

*Primary Examiner*—Milton S. Mehr

[57] ABSTRACT

A press for hydrostatic extrusion has a composite die formed of a pre-forming part with a conical opening and an end-forming and calibrated part, the two parts being separated along a substantially radial plane. The calibrating part is fixed in a radially pre-stressed condition in a support which surrounds it, and a seal between the pressure chamber and the die or the die support is arranged substantially in radial alignment with the dividing plane. The die support is formed with a guide which centers the pre-forming portion in relation to the end-forming portion.

2 Claims, 1 Drawing Figure

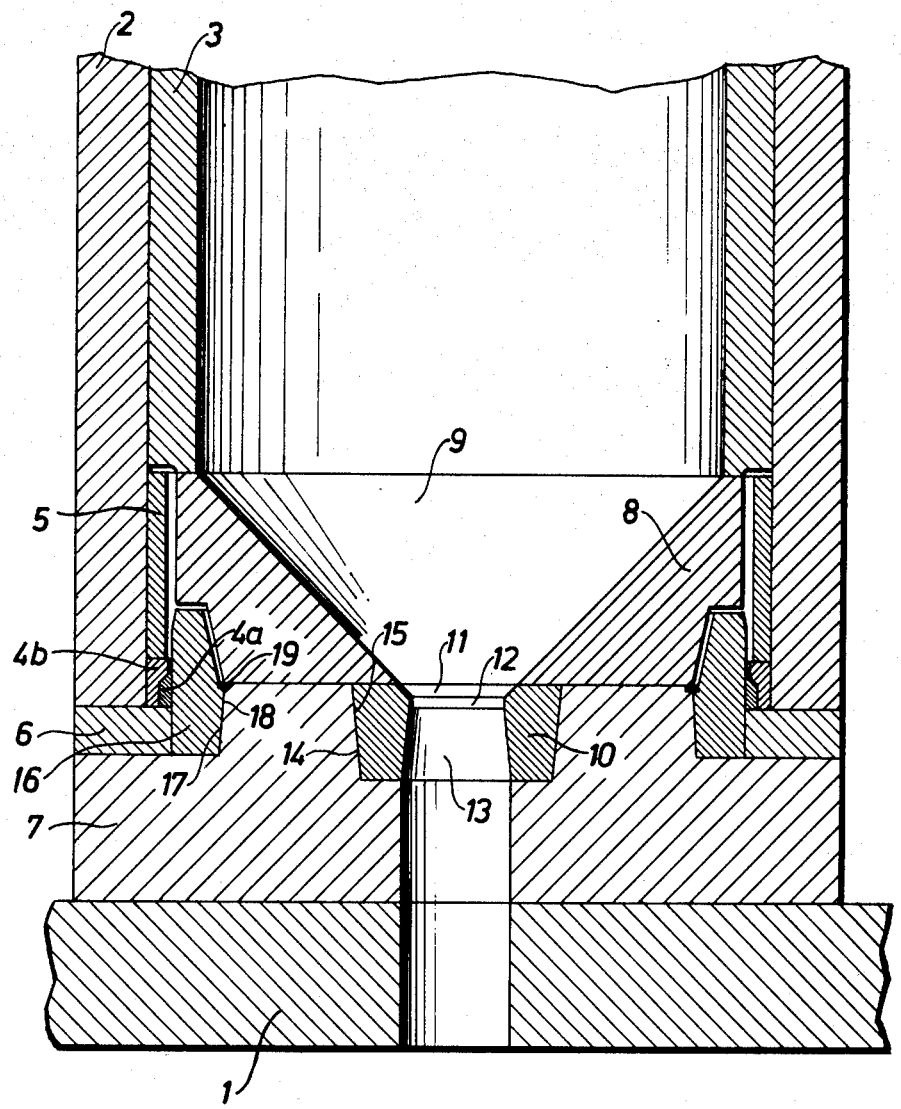
2
3
9
5
8
4b
4a
19
15
11
12
18
6
14
10
16
17
13
7
1

PRESS FOR HYDROSTATIC EXTRUSION

BACKGROUND OF THE INVENTION

1. Field of the Invention

The present invention relates to a press for hydrostatic extrusion comprising a die which is composed of two or more individual parts. The purpose of the invention is to reduce the stresses in and around the die opening and accordingly to reduce the risk of rupture and increase the life, and also to facilitate and reduce the cost of the manufacture of the die. The die is particularly intended for hot extrusion where the high temperature of the billet increases the stresses in the die. Different kinds of equipment in which the die may be used are described more fully in, for example, U.S. Pat. Nos. 3,702,555 and 3,751,958.

2. The Prior Art

In a press for hydrostatic extrusion, a die projects into a pressure chamber and rests on a die support which takes up axial forces operating outwardly on the die. Usually the die support also projects somewhat into a cylinder which forms part of the pressure chamber. The die is surrounded by the pressure medium which acts on the billet to be extruded. The pressure medium brings about forces acting radially inwardly on the outer surface of the die. The billet to be extruded brings about outwardly acting radial forces in the inlet portion of the die. Up to the die opening these radial forces balance each other, but outside the smallest calibrating cross-section of the die opening there is a clearance between a pressed product and the die, so the forces produced by the pressure medium give rise to very great stresses at the inner surface of the die. A stress factor greater than two is obtained for thick-walled tubes in case of an outer load, that is, the stresses at the inner surface are more than twice as great as at the outer surface. The outer load itself is great, usually from 10 to 15 kbar. A die manufactured in one piece has also a shape which is less suitable from the point of view of hardening, and must of course have the same high-tensile material in the inlet portion as at the die opening, in spite of the fact that the material in the inlet portion is not subjected to the same high stresses. This results in a bad utilization of the material in the inlet portion of the die.

SUMMARY OF THE INVENTION

According to the invention, the die is divided along a substantially radial plane and the die is made with a first portion which has a conical inlet opening and forms a preforming portion, and a second portion which is clamped in the die support and has an opening next to the first portion and forming an end-forming and calibrating portion. The dividing line between the die portions is located substantially in the same plane as a seal between the pressure chamber cylinder and the die or the die support when the die is in the extrusion position. The die support is formed with a guide which centers the preforming portion in relation to the end-forming and calibrating portion. This guide may consist of a guide ring arranged on the die support.

BRIEF DESCRIPTION OF THE DRAWING

The invention is described more closely with reference to the accompanying FIGURE.

BRIEF DESCRIPTION OF THE PREFERRED EMBODIMENT

In the embodiment shown, the die is shown in a press of the kind described in U.S. Pat. No. 3,751,958.

In the FIGURE, 1 designates a press table in a press stand, the rest of which is not shown, and 2 a high-pressure chamber. In the cylinder there are a support cylinder 3 for taking up forces from a tube mandrel, a seal 4 consisting of an inner sealing ring 4*a* and an outer sealing ring 4*b*, and a spacing tube 5 which holds the seal 4 axially fixed with respect to the seal holder 6. A die support 7 rests on the press table 1 and projects into the cylinder 2. The die is divided into two parts, a preforming part 8 which has a conical inlet part 9 and an end-forming and calibrating part 10 with a conical opening 11 which fits the opening 9 in the part 8, a calibrating opening 12 and a conical outlet opening 13 in which there will be a play between the wall of the opening and the pressed product. In the die support there is a conical bore hole 14. The outer surface of the die portion 10 has such external dimensions that the prestressing is achieved when the die is pressed into the bore 14.

The die support 7 is provided with a guide ring 16 for centering the die portion 8. The inner surface 17 of the guide ring and the outer surface 18 of the die support are conical and their dimensions are so adjusted that, when applying said ring, the ring will be somewhat prestressed and therefore axially fixed on the die support. A sealing ring 19 prevents the pressure medium in the pressure chamber from penetrating in between the contact surfaces of the die support and the guide ring.

The dividing line between the preforming portion 8 of the die and its end-forming portion 9 is at approximately the same level as the sealing ring 4. This means that the pressure medium operates on the outer surface of the portions 8 and that radial, inwardly directed forces are obtained which balance outwardly directed forces produced by a billet on the conical surface of the inlet portion 10. On the other hand, the pressure medium causes radial forces on the die support and the die portion clamped in said support only to a limited extent, because of the position of the seal 4 in relation to the dividing line between the die portions. When a suitable position of the diving line in relation to the seal 4 has been chosen, it is possible within certain limits to choose the desired balancing supporting force for the end-forming portion 10 of the die. In the embodiment shown, a greater supporting force will be obtained at the upper part of the portion 10 in the areas of the openings 11 and 12 than further down in the conical outlet opening, where there is play between the wall and the pressed product and, thus, no outwardly directed radial forces. A reduction of the stress can therefore be attained by means of the invention. The risk of a rupture is reduced and the life increases. By selecting a suitable value for the prestressing of the die portion 10 and by selecting a suitable position for the dividing line in relation to the seal 4, the most favorable stress conditions and a maximum life of the die can be obtained.

Another advantage obtained by the invention is that it is possible to choose different materials in different parts of the die. This means that hightensile, expensive material need only be used in the end-forming and calibrating portion 10 of the die, which has relatively small dimensions. This will reduce the cost of the die.

The invention also makes it possible in practice to make use of hard metal in the die. The die has also a simple shape and can therefore be given improved properties, for example higher strength, by heat treatment more easily than a die made in one piece. It will also be less sensitive to heat shocks which are unavoidable in hot hydrostatic extrusion. One further advantage is that the part of the die which is subjected to the greatest stress and wear is a small, relatively inexpensive and exchangeable unit.

I claim:

1. A press for hydrostatic extrusion having a pressure chamber and a die support, and a composite die comprising a pre-forming part with a conical opening and an end-forming part, said parts being separated by a substantially radial dividing plane, a support surrounding the end-forming part, the end-forming part being fixed in a radially pre-stressed condition within the support, a seal between the pressure chamber and the die or die support, the said dividing plane intersecting the seal.

2. In a press as claimed in claim 1, a guide means thereon for centering the pre-forming portion in relation to the end-forming portion.

* * * * *